US007901859B2

(12) United States Patent
Vanbesien et al.

(10) Patent No.: US 7,901,859 B2
(45) Date of Patent: Mar. 8, 2011

(54) CHEMICAL TONER WITH COVALENTLY BONDED RELEASE AGENT

(75) Inventors: Daryl W Vanbesien, Burlington (CA); Edward G Zwartz, Mississauga (CA); Cuong Vong, Hamilton (CA); Maria N V McDougall, Oakville (CA); Timothy P Bender, Toronto (CA); Jennifer L Belelie, Oakville (CA); Tyler Norsten, Oakville (CA)

(73) Assignee: Xerox Corporation, Stamford, CT (US)

( * ) Notice: Subject to any disclaimer, the term of this patent is extended or adjusted under 35 U.S.C. 154(b) by 1001 days.

(21) Appl. No.: 11/733,367

(22) Filed: Apr. 10, 2007

(65) Prior Publication Data

US 2008/0254381 A1 Oct. 16, 2008

(51) Int. Cl.
*G03G 9/00* (2006.01)

(52) U.S. Cl. ..... 430/109.3; 430/137.14

(58) Field of Classification Search ..... 430/109.3, 430/137.14
See application file for complete search history.

(56) References Cited

U.S. PATENT DOCUMENTS

| | | | | |
|---|---|---|---|---|
| 5,521,266 | A | 5/1996 | Lau | |
| 6,808,851 | B2 | 10/2004 | Bartel et al. | |
| 6,962,764 | B2 | 11/2005 | Vanbesien et al. | |
| 7,005,225 | B2 | 2/2006 | Qian et al. | |
| 2004/0185367 | A1 | 9/2004 | Serizawa et al. | |
| 2005/0282078 | A1 * | 12/2005 | Kataoka et al. | 430/111.32 |

FOREIGN PATENT DOCUMENTS

| | | | |
|---|---|---|---|
| EP | 0 744 668 | A | 11/1996 |
| EP | 0 786 703 | A | 7/1997 |
| EP | 1 816 523 | A | 8/2007 |

* cited by examiner

*Primary Examiner*—Mark A Chapman
(74) *Attorney, Agent, or Firm*—Carter, DeLuca, Farrell & Schmidt, LLP

(57) ABSTRACT

A chemical toner composition including a polymer polymerized from starting ingredients comprising a resin monomer and a release agent monomer.

18 Claims, No Drawings

CHEMICAL TONER WITH COVALENTLY BONDED RELEASE AGENT

BACKGROUND OF THE INVENTION

For those xerographic printing/copying devices which employ chemical toner and an oil-less fusing subsystem, the chemical toner conventionally incorporates a non-covalently bonded release agent to provide release of the fused toner from the fuser roll. The non-covalently bonded release agent is typically a wax such as polyethylene or carnuba wax that has to be made into an aqueous dispersion which is a costly process. Further, wax domain size and location within the toner particles play a key role in several fusing properties such as minimum fusing temperature, gloss, document offset, and hot offset. Controlling the wax domain size and location may be problematic but are important parameters in how well toners perform. There is a need, addressed by embodiments of the present invention, for new chemical toners, particularly new emulsion aggregation toners, that minimize or eliminate the disadvantages described above regarding the use of a non-covalently bonded release agent in chemical toners.

The following documents provide background information:

Qian et al., U.S. Pat. No. 7,005,225.

Lau, U.S. Pat. No. 5,521,266.

Bartel et al., U.S. Pat. No. 6,808,851.

Vanbesien et al., U.S. Pat. No. 6,962,764.

SUMMARY OF THE DISCLOSURE

There is provided in embodiments a chemical toner composition comprising a polymer polymerized from starting ingredients comprising a resin monomer and a release agent monomer.

There is further provided in embodiments an emulsion aggregation toner composition comprising a polymer polymerized from starting ingredients comprising a resin monomer and a release agent monomer.

In additional embodiments, there is provided a process comprising:

(a) forming a dispersion comprising (i) a disperse phase including starting ingredients comprising a resin monomer and a release agent monomer; and (ii) a continuous phase including starting ingredients comprising water and a phase transport catalyst;

(b) polymerizing the resin monomer and the release agent monomer to result in a polymer;

(c) aggregating toner precursor materials comprising the polymer and a colorant to result in aggregated toner precursor materials; and (d) coalescing the aggregated toner precursor materials to result in an emulsion aggregation toner composition comprising the colorant and the polymer.

DETAILED DESCRIPTION

As used herein, the term "a" such as in "a resin monomer," "a release agent monomer," "a phase transport catalyst," and the like indicates one type of such an entity, or two, three, or more different types of such an entity. For example, the resin monomer can comprise in embodiments two different types of monomers.

The phrase "chemical toner" refers to toner prepared by newer chemical methods as contrasted with older generation toner which is prepared by mechanical grinding processes. "Chemical toner" can be prepared by a variety of processes including for example emulsion aggregation (to result in "emulsion aggregation toner") and suspension polymerization.

Advantageously, embodiments of the present invention permit elimination of a release agent as a separately added, non-covalently bonded component in the chemical toner (especially, emulsion aggregation toner) making process. In embodiments, incorporating a release agent, for example, a waxy monomer octadecylacrylate, directly into the backbone of the resin polymer, enables a greater control of wax domain size and location, as well as simplifying the chemical toner preparation by eliminating one of the discrete components in the toner. In embodiments, this may increase reproducibility due to less variation in raw materials, as well as lower total cost of ownership of chemical toner for oil-less fusing applications by eliminating the costly wax from the formulation.

Representative toner compositions will now be described comprising a non crosslinked resin, a wax, and a colorant; and a process for preparing a toner comprising mixing a non crosslinked resin, a wax, a colorant, and a coagulant to provide toner size aggregates; optionally adding additional resin latex to the formed aggregates thereby providing a shell over the formed aggregates; heating the aggregates to form coalesced toner; and, optionally, isolating the toner. In embodiments, the toner process includes providing an anionic surfactant in an amount of for example about 0.01% to about 20% by weight based upon a total weight of the reaction mixture; wherein for example the anionic surfactant is selected from the group consisting of sodium dodecylsulfate, sodium dodecylbenzene sulfonate, sodium dodecylnaphthalene sulfate, dialkyl benzenealkyl, sulfates, sulfonates, adipic acid, hexa decyldiphenyloxide disulfonate, or mixtures thereof. In further embodiments, the shell thus formed has, for example, a thickness of about 0.3 to about 0.8 micrometers.

Although a non crosslinked resin is described in embodiments for the present toner composition and for a process for preparing such toner composition, it is understood that in embodiments a crosslinked resin can be used in place of or in addition to the non crosslinked resin for the present toner composition and for a process for preparing such toner composition.

Release Agent Monomer

The phrase "release agent monomer" refers to any monomer that when used to make the present chemical toner composition provides satisfactory release of the fused toner from the fuser roll without the use of fuser oil. In embodiments, the release agent monomer has at least two features: (1) a long chain aliphatic group (e.g., at least about 15 carbon atoms, or from about 15 to about 200 carbon atoms, or from about 18 to about 100 carbon atoms); and (2) a double bond which is polymerizable using for example radical polymerization.

Suitable release agent monomers include for example acrylic monomers such as

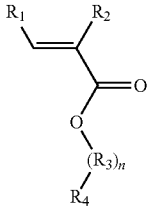

where $R_1$ is hydrogen or carboxylic acid or a salt thereof, $R_2$ is hydrogen, or methyl, or ethyl, $R_3$ is a methylene group wherein n is from about 15 to about 200, or $R_3$ is an ethoxy, propoxy or butoxy group, or a propylene group, wherein n is from about 10 to about 100, $R_4$ is a methyl group, a hydroxyl group, or a carboxylic acid group or a salt thereof. For example the acrylic monomer can be octadecyl acrylate.

Suitable release agent monomers may also include for example styrenic monomers such as:

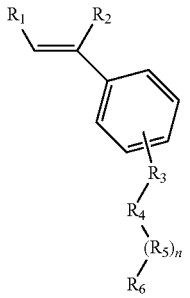

where $R_1$ is a hydrogen, or a methyl group, $R_2$ is a hydrogen, or a methyl group, $R_3$ is a methylene group, an oxygen, or a carbonyl group, $R_4$ is a methylene group or an oxygen, $R_5$ is a methylene group, n is from about 15 to about 200, or $R_5$ is an ethoxy, propoxy or butoxy group or a propylene group wherein n is from about 10 to about 100, $R_6$ is a hydrogen, a methyl group, a hydroxyl group, or a carboxylic acid group or a salt thereof.

The concentration of release agent monomer in the toner may be from about 3 to about 20 percent by weight, such as from about 4 to about 13 percent by weight or about 5 to about 12 percent by weight.

Resin Monomer

Illustrative examples of resin monomers include, but are not limited to the following (specific combinations of monomers are also described for the polymer): styrene acrylates, styrene methacrylates, butadienes, isoprene, acrylonitrile, acrylic acid, methacrylic acid, beta-carboxy ethyl arylate, esters, styrene-butadiene, methyl styrene-butadiene, methyl methacrylate-butadiene, ethyl methacrylate-butadiene, propyl methacrylate-butadiene, butyl methacrylate-butadiene, methyl acrylate-butadiene, ethyl acrylate-butadiene, propyl acrylate-butadiene, butyl acrylate-butadiene, styrene-isoprene, methyl styrene-isoprene, methyl methacrylate-isoprene, ethyl methacrylate-isoprene, propyl methacrylate-isoprene, butyl methacrylate-isoprene, methyl acrylate-isoprene, ethyl acrylate-isoprene, propyl acrylate-isoprene, butyl acrylate-isoprene; styrene-propyl acrylate, styrene-butyl acrylate, styrene-butadiene-acrylic acid, styrene-butadiene-methacrylic acid, styrene-butyl acrylate-acrylic acid, styrene-butyl acrylate-methacrylic acid, styrene-butyl acrylate-acrylonitrile, styrene-butyl acrylate-acrylonitrile-acrylic acid, styrene/butyl acrylate/carboxylic acid, styrene/butyl acrylate/beta-carboxy ethyl acrylate, and the like.

In embodiments, for example, the resin may be selected to contain a carboxylic acid group selected, for example, from the group comprised of, but not limited to, acrylic acid, methacrylic acid, itaconic acid, beta carboxy ethyl acrylate (beta CEA), fumaric acid, maleic acid, and cinnamic acid, and wherein, for example, a carboxylic acid is selected in an amount of form about 0.1 to about 10 weight percent of the total weight of the resin.

In embodiments, the selected non crosslinked resin has a weight average molecular weight of at least about 10,000, such as from about 15,000 to about 120,000 or about 200,000. In embodiments, the non crosslinked resin has a weight average molecular weight of from about 10,000 to about 200,000, such as from about 15,000 or from about 27,000 or from about 30,000 to about 90,000 or to about 120,000 or to about 200,000. In embodiments, the non crosslinked resin has a number average molecular weight of from about 5,000 to about 100,000, such as from about 7,000 to about 50,000, or from about 9,000 to about 30,000.

In embodiments, the non crosslinked resin is substantially free of crosslinking. As used herein, "substantially free of crosslinking" (also referred to herein as a non crosslinked resin) refers for example to a resin having less than about 10 percent, such as less than about 5 percent, less than about 1 percent, or less than about 0.1 percent, crosslinking between polymer chains. Thus, in embodiments the resin latex is substantially free of cross-linking as to any functional groups that may be present in the resin, meaning that the entire resin latex has for example less than about 10 percent, such as less than about 5 percent, less than about 1 percent, or less than about 0.1 percent, crosslinking.

In embodiments, the toner composition may include crosslinked resins, besides the specified non crosslinked resin. For example, such crosslinked resins or any crosslinked resins are present in an amount from 0 to about 15 percent or to about 20 percent by weight, such as in a total amount of from 0 to about 15 percent by weight, based on a total weight of the toner composition.

Polymer Polymerized from Resin Monomer and Release Agent Monomer

Illustrative formulations for the polymer include the following:

Polystyrene/butylacrylate/octadecylacrylate 78/7.5/14.5 (the overall loading of octadecylacrylate in the toner may be for example about 9% by weight of the polymer since there can be added pigment and gel into the toner formulation)

Polystyrene/butadiene/octadecylacrylate 78/7.5/14.5

Polystyrene/butylacrylate/docosanylacrylate 78/7.5/14.5

Polystyrene/butylacrylate/triacontylacrylate 78/7.5/14.5

Polystyrene/butylacrylate/hexacosylacrylate 78/7.5/14.5

Polystyrene/butylacrylate/1-(docosyloxy)-4-vinylbenzene 63.5/22/14.5

Polystyrene/butylacrylate/1-(hexacosyloxy)-4-vinylbenzene 63.5/22/14.5.

As will be apparent, the properties of the non crosslinked resin can be suitably adjusted by adjusting the types and amounts of constituent monomers, adjusting the type and amount of chain transfer agents, and the like. For example, adjusting the ratio of constituent monomers can adjust the toner glass transition temperature (Tg), which in turn can effect toner blocking properties, fusing properties, and the like.

Likewise, adjusting the amount of chain transfer agent used in forming the resin latexes used for the core and/or shell resin components, can adjust resin properties. For example, using different amounts of chain transfer agent, such as dodecanethiol, when forming the resin latex, can change the resin's properties such as molecular weight, glass transition temperature, and the like. For example, increasing the amount of chain transfer agent in forming the core resin latex, can decrease the molecular weight due to chain termination during polymerization; while decreasing the amount of chain transfer agent in forming the shell resin latex will increase the molecular weight, which can aid in toner blocking properties.

The monomer units used to form the resin latex or latexes can be suitably polymerized by any known process. For example, the monomer units can be polymerized, in a starve fed semi-continuous emulsion polymerization process, a standard emulsion polymerization process, or the like, to provide the resin latex. Such polymerizations can be carried out, for example, in the presence of an initiator, a chain transfer agent (CTA), and surfactant.

In embodiments, the resin or polymer is a styrene/butyl acrylate/beta-carboxyethylacrylate terpolymer. In other embodiments, the resin or polymer can be styrene/butyl acrylate/acrylic acid terpolymer, styrene/butyl acrylate/methacrylic acid terpolymer, styrene/butyl acrylate/itaconic acid terpolymer, styrene/butyl acrylate/furmaic acid terpolymer, styrene/butadiene/beta-carboxyethylacrylate terpolymer, styrene/butadiene/methacrylic acid terpolymer, styrene/butadiene/acrylic acid terpolymer, styrene/isoprene/beta-carboxyethylacrylate terpolymer and the like.

In embodiments, the resin substantially free of crosslinking comprises styrene:butylacrylate:beta-carboxy ethyl acrylate wherein, for example, the non crosslinked resin monomers are present in an amount of about 70% to about 90% styrene, about 10% to about 30% butylacrylate, and about 0.05 parts per hundred to about 10 parts per hundred beta-CEA, such as about 3 parts per hundred beta-CEA, by weight based upon the total weight of the monomers. However, the component ratios are not limited to these ranges, and other amounts can be used.

In a feature herein, the non crosslinked resin comprises about 73% to about 85% styrene, about 27% to about 15% butylacrylate, and about 1.0 part per hundred to about 5 parts per hundred beta-CEA, by weight based upon the total weight of the monomers although the compositions and processes are not limited to these particular types of monomers or ranges. In another feature, the non crosslinked resin comprises about 81.7% styrene, about 18.3% butylacrylate, and about 3.0 parts per hundred beta-CEA, by weight based upon the total weight of the monomers.

The initiator may be, for example, but is not limited to, sodium, potassium or ammonium persulfate and may be present in the range of, for example, about 0.5 to about 3.0 percent based upon the weight of the monomers, although not limited. The chain transfer agent may be present in an amount of from about 0.5 to about 5.0 percent by weight based upon the combined weight of the monomers, although not limited. In embodiments, the surfactant is an anionic surfactant present in the range of about 0.7 to about 5.0 percent by weight based upon the weight of the aqueous phase, although not limited to this type or range.

For example, the monomers can be polymerized under starve fed conditions as referred to in U.S. Pat. Nos. 6,447,974, 6,576,389, 6,617,092, and 6,664,017, the entire disclosure of which are incorporated herein by reference, to provide latex resin particles having a diameter in the range of about 100 to about 300 nanometers.

In embodiments, the onset glass transition temperature (Tg) of the non crosslinked resin can be in the range of, for example, from about 48° C. to about 62° C., or about 50° C. to about 60° C. such as about 53° C. to about 60° C., although not limited.

Surfactants

For example, surfactants in amounts of about 0.01 to about 20, or about 0.1 to about 15 weight percent of the reaction mixture in embodiments can be used. Examples of suitable surfactants include, for example, nonionic surfactants such as dialkylphenoxypoly(ethyleneoxy) ethanol, available from Rhone-Poulenc as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. For example, an effective concentration of the nonionic surfactant is, in embodiments, from about 0.01 percent to about 10 percent by weight, or from about 0.1 percent to about 5 percent by weight of the reaction mixture.

Examples of anionic surfactants being include sodium dodecylsulfate (SDS), sodium dodecylbenzene sulfonate, sodium dodecylnaphthalene sulfate, dialkyl benzenealkyl, sulfates and sulfonates, adipic acid, available from Aldrich, NEOGEN R™, NEOGEN SC™, available from Kao, Dowfax 2A1 (hexa decyldiphenyloxide disulfonate) and the like, among others. For example, an effective concentration of the anionic surfactant generally employed can be from about 0.01 percent to about 10 percent by weight, or from about 0.1 percent to about 5 percent by weight of the reaction mixture.

One or more bases can also be used to increase the pH and hence ionize the aggregate particles thereby providing stability and preventing the aggregates from growing in size. Examples of bases that can be selected include sodium hydroxide, potassium hydroxide, ammonium hydroxide, cesium hydroxide and the like, among others.

Additional surfactants can also optionally be added to the aggregate suspension prior to or during the coalescence. Such additional surfactants can be used, for example, to prevent the aggregates from growing in size, or for stabilizing the aggregate size, with increasing temperature. Suitable additional surfactants can be selected from anionic surfactants such as sodium dodecylbenzene sulfonate, sodium dodecylnaphthalene sulfate, dialkyl benzenealkyl, sulfates and sulfonates, adipic acid, available from Aldrich, NEOGEN R™, NEOGEN SC™ available from Kao, and the like, among others. These surfactants can also be selected from nonionic surfactants such as polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy) ethanol, available from Rhone-Poulenac as IGEPAL CA-210™, IGEPAL CA-520™, IGEPAL CA-72™, IGEPAL CO-890™, IGEPAL CO-720™, IGEPAL CO-290™, IGEPAL CA-210™, ANTAROX 890™ and ANTAROX 897™. An effective amount of the anionic or nonionic surfactant generally employed as an aggregate size stabilization agent is, for example, about 0.01 percent to about 10 percent or about 0.1 percent to about 5 percent, by weight of the reaction mixture.

Examples of the acids that can be utilized include, for example, nitric acid, sulfuric acid, hydrochloric acid, acetic acid, citric acid, trifluoroacetic acid, succinic acid, salicylic acid and the like, and which acids are in embodiments utilized in a diluted form in the range of about 0.5 to about 10 weight percent by weight of water or in the range of about 0.7 to about 5 weight percent by weight of water.

Phase Transport Catalyst

The phase transport catalyst is a macromolecular organic compound having a hydrophobic cavity such as those described in Lau, U.S. Pat. No. 5,521,266, the disclosure of which is totally incorporated herein by reference.

Useful macromolecular organic compounds having a hydrophobic cavity include for example cyclodextrin and cyclodextrin derivatives; cyclic oligosaccharides having a hydrophobic cavity such as cycloinulohexose, cycloinuloheptose, and cycloinuloctose; calyxarenes; and cavitands.

The cyclodextrin and cyclodextrin derivatives useful in embodiments of the present invention may be limited only by the solubility of the cyclodextrin and cyclodextrin derivative selected under the particular polymerization conditions. Suitable cyclodextrins include, but are not limited to alpha-cyclodextrin, beta-cyclodextrin and gamma-cyclodextrin. Suitable cyclodextrin derivatives include, but are not limited to, the methyl, triacetyl hydroxypropyl and hydroxyethyl derivatives of alpha-cyclodextrin, beta-cyclodextrin and gamma-cyclodextrin. In embodiments, the cyclodextrin derivative is methyl-beta-cyclodextrin.

Suitable cyclic oligosaccharides having a hydrophobic cavity, such as cycloinulohexose, cycloinuloheptose, are described by Takai et al., Journal of Organic Chemistry, 1994, volume 59, number 11, pages 2967-2975, the disclosure of which is totally incorporated herein by reference.

Suitable calyxarenes are described in U.S. Pat. No. 4,699,966, International Patent Publication WO 89/08092 and Japanese patent publications 1988/197544 and 1989/007837, the disclosures of which are totally incorporated herein by reference.

Suitable cavitands are described in Italian application 22522 A/89 and Moran et al., Journal of the American Chemical Society, volume 184, 1982, pages 5826-5828, the disclosures of which are totally incorporated herein by reference.

The chain transport catalyst can be used in the concentration of from about 0.3% to about 70%, or from about 0.5% to about 30%, or from about 1% to about 5% by weight of release agent monomer.

Non-Covalently Bonded Release Agent

In embodiments, the present chemical toner is substantially free of a non-covalently bonded release agent. But in other embodiments, the present chemical toner composition optionally includes a non-covalently bonded release agent such as a wax. For example, waxes suitable for the present toner compositions include, but are not limited to, alkylene waxes such as alkylene wax having about 1 to about 25 carbon atoms, such as polyethylene, polypropylene or mixtures thereof. The wax can be present, for example, in an amount of about 6% to about 15% by weight based upon the total weight of the composition. Examples of waxes include those as illustrated herein, such as those of the aforementioned co-pending applications, polypropylenes and polyethylenes commercially available from Allied Chemical and Petrolite Corporation, wax emulsions available from Michaelman Inc. and the Daniels Products Company, Epolene N-15™ commercially available from Eastman Chemical Products, Inc., Viscol 550-P™, a low weight average molecular weight polypropylene available from Sanyo Kasei K.K., and similar materials. The commercially available polyethylenes possess, it is believed, a molecular weight (Mw) of about 100 to about 3,000, and the commercially available polypropylenes are believed to possess a molecular weight of about 1,000 to about 10,000. Examples of functionalized waxes include amines, amides, for example Aqua Superslip 6550™, Superslip 6530™ available from Micro Powder Inc., fluorinated waxes, for example Polyfluo 190™, Polyfluo 200™, Polyfluo 523XF™, Aqua Polyfluo 411™, Aqua Polysilk 19™, Polysilk 14™ available from Micro Powder Inc., mixed fluorinated, amide waxes, for example Microspersion 19™ also available from Micro Powder Inc., imides, esters, quaternary amines, carboxylic acids or acrylic polymer emulsion, for example Joncryl 74™, 89™, 130™, 537™, and 538™, all available from SC Johnson Wax, chlorinated polypropylenes and polyethylenes available from Allied Chemical and Petrolite Corporation and SC Johnson Wax. Monomer versions of the non-covalently bonded release agents (e.g., waxes) can be used as the release agent monomer.

In embodiments, the wax comprises a wax in the form of a dispersion comprising, for example, a wax having a particle diameter of about 100 nanometers to about 500 nanometers, water, and an anionic surfactant. In embodiments, the wax can be included in amounts such as about 6 to about 15 weight percent. In embodiments, the wax comprises polyethylene wax particles, such as Polywax 850, commercially available from Baker Petrolite, although not limited thereto, having a particle diameter in the range of about 100 to about 500 nanometers, although not limited. The surfactant used to disperse the wax can be an anionic surfactant, although not limited thereto, such as, for example, Neogen RK™ commercially available from Kao Corporation or TAYCAPOWER BN2060 commercially available from Tayca Corporation.

Colorant

The toner composition also includes at least one colorant, such as a dye and/or a pigment. For example, colorants include pigment, dye, mixtures of pigment and dye, mixtures of pigments, mixtures of dyes, and the like. For simplicity, the term "colorant" refers for example to such organic soluble dyes, pigments, and mixtures, unless specified as a particular pigment or other colorant component. In embodiments, the colorant comprises carbon black, magnetite, black, cyan, magenta, yellow, red, green, blue, brown, or mixtures thereof, in an amount of about 1% to about 25%, such as about 2% or about 5% to about 15% or about 20%, by weight based upon the total weight of the composition. It is to be understood that other useful colorants will become readily apparent based on the present disclosure.

In general, useful colorants include, but are not limited to, black colorants such as Paliogen Black L9984 (BASF), Pigment Black K801 (BASF) and carbon blacks such as REGAL 330 (Cabot), REGAL 660 (Cabot), Carbon Black 5250 and 5750 (Columbian Chemicals), and the like or mixtures thereof.

Additional useful colorants include pigments in water based dispersions such as those commercially available from Sun Chemical, for example SUNSPERSE BHD 6011X (Blue 15 Type), SUNSPERSE BHD 9312X (Pigment Blue 15 74160), SUNSPERSE BHD 6000X (Pigment Blue 15:3 74160), SUNSPERSE GHD 9600X and GHD 6004X (Pigment Green 7 74260), SUNSPERSE QHD 6040X (Pigment Red 122 73915), SUNSPERSE RHD 9668X (Pigment Red 185 12516), SUNSPERSE RHD 9365X and 9504X (Pigment Red 57 15850:1, SUNSPERSE YHD 6005X (Pigment Yellow 83 21108), FLEXIVERSE YFD 4249 (Pigment Yellow 17 21105), SUNSPERSE YHD 6020X and 6045X (Pigment Yellow 74 11741), SUNSPERSE YHD 600X and 9604X (Pigment Yellow 14 21095), FLEXIVERSE LFD 4343 and LFD 9736 (Pigment Black 7 77226) and the like or mixtures thereof. Other useful water based colorant dispersions include those commercially available from Clariant, for example, HOSTAFINE Yellow GR, HOSTAFINE Black T and Black TS, HOSTAFINE Blue B2G, HOSTAFINE Rubine F6B and magenta dry pigment such as Toner Magenta 6BVP2213 and Toner Magenta E02 which can be dispersed in water and/or surfactant prior to use.

Other useful colorants include, for example, magnetites, such as Mobay magnetites M08029, M08960; Columbian magnetites, MAPICO BLACKS and surface treated magnetites; Pfizer magnetites CB4799, CB5300, CB5600, MCX6369; Bayer magnetites, BAYFERROX 8600, 8610; Northern Pigments magnetites, NP-604, NP-608; Magnox magnetites TMB-100 or TMB-104; and the like or mixtures thereof. Specific additional examples of pigments include phthalocyanine HELIOGEN BLUE L6900, D6840, D7080, D7020, PYLAM OIL BLUE, PYLAM OIL YELLOW, PIGMENT BLUE 1 available from Paul Uhlrich & Company, Inc., PIGMENT VIOLET 1, PIGMENT RED 48, LEMON CHROME YELLOW DCC 1026, E.D. TOLUIDINE RED and BON RED C available from Dominion Color Corporation, Ltd., Toronto, Ontario, NOVAPERM YELLOW FGL, HOSTAPERM PINK E from Hoechst, and CINQUASIA MAGENTA available from E.I. DuPont de Nemours & Company, and the like. Examples of magentas include, for example, 2,9-dimethyl substituted quinacridone and anthraquinone dye identified in the Color Index as CI 60710, CI Dispersed Red 15, diazo dye identified in the Color Index as CI 26050, CI Solvent Red 19, and the like or mixtures thereof. Illustrative examples of cyans include copper tetra (octadecyl sulfonamide) phthalocyanine, x-copper phthalocyanine pigment listed in the Color Index as C174160, CI Pigment Blue, and Anthrathrene Blue identified in the Color Index as DI 69810, Special Blue X-2137, and the like or mixtures thereof. Illustrative examples of yellows that may be selected include diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,4-dimethoxy acetoacetanilide, and Permanent Yellow FGL. Colored magnetites, such as mixtures of MAPICOBLACK and cyan components may also be selected as pigments.

Other useful colorants include, but are not limited to, Paliogen Violet 5100 and 5890 (BASF), Normandy Magenta RD-2400 (Paul Uhlrich), Permanent Violet VT2645 (Paul Uhlrich), Heliogen Green L8730 (BASF), Argyle Green XP-111-S (Paul Uhlrich), Brilliant Green Toner GR 0991 (Paul Uhlrich), Lithol Scarlet D3700 (BASF), Toluidine Red (Aldrich), Scarlet for Thermoplast NSD Red (Aldrich), Lithol Rubine Toner (Paul Uhlrich), Lithol Scarlet 4440, NBD 3700 (BASF), Bon Red C (Dominion Color), Royal Brilliant Red RD-8192 (Paul Uhlrich), Oracet Pink RF (Ciba Geigy), Paliogen Red 3340 and 3871K (BASF), Lithol Fast Scarlet L4300 (BASF), Heliogen Blue D6840, D7080, K7090, K6910 and L7020 (BASF), Sudan Blue OS (BASF), Neopen Blue FF4012 (BASF), PV Fast Blue B2GO1 (American Hoechst), Irgalite Blue BCA (Ciba Geigy), Paliogen Blue 6470 (BASF), Sudan TI, III and IV (Matheson, Coleman, Bell), Sudan Orange (Aldrich), Sudan Orange 220 (BASF), Paliogen Orange 3040 (BASF), Ortho Orange OR 2673 (Paul Uhlrich), Paliogen Yellow 152 and 1560 (BASF), Lithol Fast Yellow 0991K (BASF), Paliotol Yellow 1840 (BASF), Novaperm Yellow FGL (Hoechst), Permanerit Yellow YE 0305 (Paul Uhlrich), Lumogen Yellow D0790 (BASF), Suco-Gelb 1250 (BASF), Suco-Yellow D1355 (BASF), Suco Fast Yellow D1165, D1355 and D1351 (BASF), Hostaperm Pink E (Hoechst), Fanal Pink D4830 (BASF), Cinquasia Magenta (DuPont), and the like.

Coagulant

In embodiments, the coagulants used in the present process comprises known components, such as poly metal halides, for example poly aluminum halides, such as polyaluminum chloride (PAC) or polyaluminum sulfo silicate (PASS). For example, in one embodiment, the coagulants provide a final toner having a metal content of, for example, about 400 to about 10,000 parts per million. In another embodiment, the coagulant comprises a poly aluminum chloride providing a final toner having an aluminum content of about 400 to about 10,000 parts per million, such as about 400 to about 1,000 parts per million. In embodiments, the coagulant can be present in the toner particles, exclusive of external additives and on a dry weight basis, in amounts of from 0 to about 5% by weight of the toner particles, such as from about greater than 0 to about 3% by weight of the toner particles.

Toner Particle Preparation

The toner composition is, in embodiments, prepared by an emulsion/aggregation process, such as an emulsion/aggregation/coalescing process. For example, emulsion/aggregation/coalescing processes for the preparation of toners are illustrated in a number of Xerox patents, the disclosures of each of which are totally incorporated herein by reference, such as U.S. Pat. Nos. 5,290,654, 5,278,020, 5,308,734, 5,370,963, 5,344,738, 5,403,693, 5,418,108, 5,364,729, and 5,346,797. Also of interest are U.S. Pat. Nos. 5,348,832; 5,405,728; 5,366,841; 5,496,676; 5,527,658; 5,585,215; 5,650,255; 5,650,256; 5,501,935; 5,723,253; 5,744,520; 5,763,133; 5,766,818; 5,747,215; 5,827,633; 5,853,944; 5,804,349; 5,840,462; 5,869,215; 5,863,698; 5,902,710; 5,910,387; 5,916,725; 5,919,595; 5,925,488; and 5,977,210, the disclosures of each of which are hereby totally incorporated herein by reference. In addition, Xerox patents 6,627,373; 6,656,657; 6,617,092; 6,638,677; 6,576,389; 6,664,017; 6,656,658; and 6,673,505 are each hereby totally incorporated herein by reference. The appropriate components and process aspects of each of the foregoing U.S. Patents may be selected for the present composition and process in embodiments thereof.

In embodiments, the toner preparation process comprises forming a toner particle by mixing the non crosslinked latex and optionally a crosslinked latex with a wax and a colorant dispersion, to which is added a coagulant of for example, a poly metal halide such as polyaluminum chloride while blending at high speeds such as with a polytron. The resulting mixture having a pH of about 2 to about 3 is aggregated by heating to a temperature below about the resin Tg to provide toner size aggregates. Additional non crosslinked latex (which may be the same as or different from the first non crosslinked latex, as described above) is added to the formed aggregates providing a shell over the formed aggregates. For example, in embodiments, about 10% to about 35% or about 15% to about 30% additional non crosslinked latex can be added to the formed aggregates providing a shell over the formed aggregates. The pH of the mixture is then changed by the addition of a sodium hydroxide solution until a pH of about 7 is achieved. When the mixture reaches a pH of about 7, the carboxylic acid becomes ionized to provide additional negative charge on the aggregates thereby providing stability and preventing the particles from further growth or an increase in the size distribution when heated above the Tg of the latex resin. The temperature of the mixture is then raised to about 95° C. After about 30 minutes, the pH of the mixture is reduced to a value sufficient to coalesce or fuse the aggregates to provide a composite particle upon further heating such as about 4.5. The fused particles can be measured for shape factor or circularity, such as with a Sysmex FPIA 2100 analyzer, until the desired shape is achieved.

The mixture can be allowed to cool to room temperature (about 20° C. to about 25° C.) and can optionally be washed. When the mixture is to be washed, a multiple-step wash procedure can be used, where a first wash is conducted such as at a pH of about 10 and a temperature of about 63° C. followed by a deionized water (DIW) wash at room temperature. This can then be followed by a wash at a pH of about 4.0 at a temperature of about 40° C. followed by a final DIW water wash. The toner can then be dried.

The final toner composition comprises toner particles having a non crosslinked resin, a wax, and a colorant. While not wishing to be bound by theory, in the present toner composition comprising a non crosslinked latex, a wax, and a colorant, the resin is primarily used to increase the hot offset, lower the minimum fixing temperature (MFT), and provide low gloss properties such as from about 1 to about 20 gloss units, while the wax is used to provide release characteristics. The ratio of the non crosslinked latex to the wax content and the colorant content are selected to control the rheology of the toner.

In embodiments, the final toner composition has a gloss, measured at the minimum fixing temperature, of from about 1 to about 70 gloss units, such as from about 2 or about 5 to about 50 or about 60 gloss units as measured on a BYK 75 degree micro gloss meter. "Gloss units" refers to Gardner Gloss Units measured on plain paper (such as Xerox 90 gsm COLOR XPRESSIONS+paper or Xerox 4024 paper). Crease fix MFT is measured by folding images that have been fused over a wide range of fusing temperatures and then rolling a defined mass across the folded area. The print can also be folded using a commercially available folder such as the Duplo D-590 paper folder. The sheets of paper are then unfolded and toner that has been fractured from the sheet of paper is wiped from the surface. Comparison of the fractured area is then made to an internal reference chart. Smaller fractured areas indicate better toner adhesion and the temperature required to achieve acceptable adhesion is defined as the crease fix MFT.

In embodiments, the toner comprises non crosslinked resin, wax, and colorant in an amount of about 68% to about 91% non crosslinked resin, about 4% to about 15% wax, and about 5% to about 13% colorant, by weight based upon the total weight of the composition wherein a total of the components is about 100%, although not limited thereto. In embodiments, the non crosslinked resin, the wax, and the colorant are present in an amount of about 81% non crosslinked resin, about 9% wax, and about 10% colorant, by weight based upon the total weight of the composition.

In embodiments of the present toner composition, the resultant toner possesses a shape factor of about 120 to about 140 where a shape factor of 100 is considered to be spherical, and a particle circularity of about 0.900 to about 0.980 such as about 0.930 to about 0.980 as measured on an analyzer such as a Sysmex FPIA 2100 analyzer, where a circularity of 1.00 is considered to be spherical in shape. In embodiments, the chemical toner composition comprises particles have a circularity ranging from about 0.930 to 1.000. In embodiments, the chemical toner composition comprises particles having a volume average particle size distribution index of about 1.30 or less.

In some embodiments, the toner composition can be a black toner composition. In embodiments, the black toner composition can have a Tg (onset) of from about 50 to about 60° C., a shape factor of about 120 to about 140, and a circularity of about 0.900 to about 0.980. In other embodiments, the toner composition can include a high Mw non crosslinked resin that comprises of styrene:butylacrylate: Beta-CEA in the ratio of about 72:28:3 pph by weigh of monomer. In other embodiments, the toner composition can include an optional amount of a crosslinked resin that comprises styrene:butylacrylate:Beta-CEA:DVB (divinyl benzene) in the ratio of about 65:53:3:1 pph by weight of monomer.

The toner particles can optionally be blended with external additives following formation. Any suitable surface additives may be used in embodiments. Suitable external additives include, for example, $SiO_2$, metal oxides such as $TiO_2$ and aluminum oxide, lubricating agent such as metal salts of fatty acids (such as zinc stearate or calcium stearate), long chain alcohols such as UNILIN® 700, and the like. In general, silica is applied to the toner surface for toner flow, tribo enhancement, admix control, improved development and transfer stability and higher toner blocking temperature. $TiO_2$ is applied for improved relative humidity (RH) stability, tribo control and improved development and transfer stability. Zinc stearate is applied to provide lubricating properties. Zinc stearate provides developer conductivity and tribo enhancement, both due to its lubricating nature. The external surface additives can be used with or without a coating.

In embodiments, the toners contain from, for example, about 0.1 to about 5 weight percent titania and/or other metal oxides, about 0.1 to about 8 weight percent silica, and about 0.1 to about 4 weight percent zinc stearate or other metal stearates.

The toner particles of the disclosure can optionally be formulated into a developer composition by mixing the toner particles with carrier particles. Illustrative examples of carrier particles that can be selected for mixing with the toner composition prepared in accordance with the present disclosure include those particles that are capable of triboelectrically obtaining a charge of opposite polarity to that of the toner particles. Accordingly, in one embodiment the carrier particles may be selected so as to be of a negative polarity in order that the toner particles that are positively charged will adhere to and surround the carrier particles. Illustrative examples of such carrier particles include iron, iron alloys, steel, nickel, iron ferrites, including ferrites that incorporate strontium, magnesium, manganese, copper, zinc, and the like, magnetites, and the like. Additionally, there can be selected as carrier particles nickel berry carriers as disclosed in U.S. Pat. No. 3,847,604, the entire disclosure of which is totally incorporated herein by reference, comprised of nodular carrier beads of nickel, characterized by surfaces of reoccurring recesses and protrusions thereby providing particles with a relatively large external area. Other carriers are disclosed in U.S. Pat. Nos. 4,937,166 and 4,935,326, the disclosures of which are totally incorporated herein by reference.

The selected carrier particles can be used with or without a coating, the coating generally being comprised of acrylic and methacrylic polymers, such as methyl methacrylate, acrylic and methacrylic copolymers with fluoropolymers or with monoalkyl or dialkylamines, fluoropolymers, polyolefins, polystyrenes, such as polyvinylidene fluoride resins, terpolymers of styrene, methyl methacrylate, and a silane, such as triethoxy silane, tetrafluoroethylenes, other known coatings and the like.

The carrier particles can be mixed with the toner particles in various suitable combinations. The toner concentration is usually about 2% to about 10% by weight of toner and about 90% to about 98% by weight of carrier. However, different toner and carrier percentages may be used to achieve a developer composition with desired characteristics.

Toners of the present disclosure can be used in electrostatographic (including electrophotographic) imaging methods. Thus for example, the toners or developers of the disclosure can be charged, such as triboelectrically, and applied to an oppositely charged latent image on an imaging member such as a photoreceptor or ionographic receiver. The resultant toner image can then be transferred, either directly or via an intermediate transport member, to a support such as paper or a transparency sheet. The toner image can then be fused to the support by application of heat and/or pressure, for example with a heated fuser roll.

It is envisioned that the toners of the present disclosure may be used in any suitable procedure for forming an image with a toner, including in applications other than xerographic applications.

The invention will now be described in detail with respect to specific representative embodiments thereof, it being understood that these examples are intended to be illustrative only and the invention is not intended to be limited to the materials, conditions, or process parameters recited herein. All percentages and parts are by weight unless otherwise indicated. Room temperature refers to a temperature ranging from about 20 to about 25 degrees C.

EXAMPLE

Preparation of Latex A (for an Emulsion Aggregation Process) Containing 14.5% by Weight Octadecylacrylate

Release Agent Monomer

Cyclodextrin was used as a phase transport catalyst to prepare a latex containing 14.5 weight percent octadecylacrylate as follows. A surfactant solution consisting of 0.8 grams Dowfax 2A1 (anionic emulsifier), 2.7 grams of beta-cyclodextrin, and 514 grams of de-ionized water was prepared by mixing for 10 minutes in a stainless steel holding tank. The holding tank was then purged with nitrogen for 5 minutes before transferring into the reactor. The reactor was then continuously purged with nitrogen while being stirred at 300 RPM. The reactor was then heated up to 76° C. at a controlled rate, and held there. Separately 8.1 grams of ammonium persulfate initiator was dissolved in 45 grams of de-ionized water. Separately the monomer emulsion was prepared in the following manner. 421.2 grams of styrene, 40.5 grams of butyl acrylate, 78.3 grams of octadecylacrylate, 16.2 grams of beta-carboxyethylacrylate, 3.78 grams of 1-dodecanethiol, 1.89 grams of 1,10-decanedioldiacrylate, 10.69 grams of Dowfax 2A1(anionic surfactant), and 257 grams of deionized water were mixed to form an emulsion. 1% of the above emulsion was then slowly fed into the reactor containing the aqueous surfactant phase at 76° C. to form the "seeds" while being purged with nitrogen. The initiator solution was then slowly charged into the reactor and after 10 minutes half of the emulsion is continuously fed in a using metering pump at a rate of 0.5%/min. After 100 minutes when half of the monomer emulsion had been added to the reactor, an additional 4.54 grams of 1-dodecanethiol was stirred into the monomer emulsion, and the emulsion is continuously fed in at a rate of 0.5%/min. Also at this time the reactor stirrer was increased to 350 RPM. Once all the monomer emulsion was charged into the main reactor, the temperature was held at 76° C. for an additional 4 hours to complete the reaction. Full cooling was then applied and the reactor temperature is reduced to 35° C. The product was collected into a holding tank. After drying the latex, the molecular properties were Mw=53,300, Mn=10,300 and the onset Tg was 49.4° C.

A differential scanning calorimetry curve of the latex was then prepared. The DSC curve shows the octadecylacrylate melting point around 34.9° C. and a Tg onset around 49.6° C. This latex had no fouling or coarse formation.

Preparation of Latex B (Crosslinked Resin)

A latex emulsion comprised of polymer gel particles generated from the semi-continuous emulsion polymerization of styrene, n-butyl acrylate, divinylbenzene, and Beta-CEA was prepared as follows.

A surfactant solution consisting of 1.75 kilograms Neogen RK (anionic emulsifier) and 145.8 kilograms de-ionized water was prepared by mixing for 10 minutes in a stainless steel holding tank. The holding tank was then purged with nitrogen for 5 minutes before transferring into the reactor. The reactor was then continuously purged with nitrogen while being stirred at 300 RPM. The reactor was then heated up to 76° C. at a controlled rate and held constant. In a separate container, 1.24 kilograms of ammonium persulfate initiator was dissolved in 13.12 kilograms of de-ionized water. Also in a second separate container, the monomer emulsion was prepared in the following manner. 47.39 kilograms of styrene, 25.52 kilograms of n-butyl acrylate, 2.19 kilograms of beta-CEA, and 729 grams of 55% grade divinylbenzene, 4.08 kilograms of Neogen RK (anionic surfactant), and 78.73 kilograms of deionized water were mixed to form an emulsion. The ratio of styrene monomer to n-butyl acrylate monomer by weight was 65 to 35 percent. One percent of the above emulsion is then slowly fed into the reactor containing the aqueous surfactant phase at 76° C. to form the "seeds" while being purged with nitrogen. The initiator solution is then slowly charged into the reactor and after 20 minutes the rest of the emulsion is continuously fed in using metering pumps.

Once all the monomer emulsion is charged into the main reactor, the temperature is held at 76° C. for an additional 2 hours to complete the reaction. Full cooling is then applied and the reactor temperature is reduced to 35° C. The product is collected into a holding tank after filtration through a 1 micron filter bag. After drying a portion of the latex the molecular properties were measured to be Mw=134,700, Mn=27,300 and the onset Tg was 43.0° C. The average particle size of the latex as measured by Disc Centrifuge was 48 nanometers and residual monomer as measured by GC as <50 ppm for styrene and <100 ppm for n-butyl acrylate.

Preparation of Emulsion Aggregation Toner Containing Covalently Bonded Release Agent for Oil-Less Fusing 257.4 grams of the latex A having a solids loading of 41.95 weight %, 100.6 grams of black pigment dispersion Cavitron PD-K85 (Regal 330) having a solids loading of 17.05 weight %, and 80 grams of latex B having a solids content of 25 weight %, are added to 585.5 grams of deionized water in a vessel while being stirred using an IKA Ultra Turrax® T50 homogenizer operating at 4,000 rpm. After 5 minutes of homogenizing the solution at 4000 RPM was followed a drop-wise addition of 34 grams of a flocculent mixture containing 3.4 grams polyaluminum chloride mixture and 30.6 grams 0.02 molar nitric acid solution. Thereafter, the mixture was heated at 1° C. per minute to a temperature of 51° C. and held there for a period of about 1.5 to about 2 hours resulting in a volume average particle diameter of 5.2 micrometers as measured with a Coulter Counter. During heat up period, the stirrer was run at about 250 rpm and 10 minutes after the set temperature of 51° C. was reached, the stirrer speed was reduced to about 220 rpm. An additional 133.5 grams of latex A was added to the reactor mixture and heated to a temperature of 52° C. and held there for an additional period of about 30 minutes resulting in a volume average particle diameter of about 5.8 micrometers. Adjusting the reactor mixture pH to 6 with 1.0 M sodium hydroxide solution freezes the particle size. Thereafter, the reactor mixture was heated at 1° C. per minute to a temperature of 95° C., followed by adjusting the reactor mixture pH to 4.0 with 0.3 M nitric acid solution. Following this, the reactor mixture was gently stirred at 95° C. for 2.5 hours to enable the particles to coalesce and spherodize. When the desired shape was achieved, as measured on a Sysmex FPIA shape analyzer, the pH was brought to pH 7.0. Following a full 2.5 hours at 93° C. the reactor heater was then turned off and the reactor mixture was allowed to cool to room temperature at rate of one degree C. per minute. The resulting toner mixture was comprised of about 16.7 percent of toner, 0.25 percent of anionic surfactant and about 82.9 percent by weight of water. The toner of this mixture comprises about 82 percent of styrene/acrylate polymer, about 8 percent of Regal 330 pigment, and about 10 percent by weight latex B and has a volume average particle diameter of about 5.9 micrometers and a Geometric Standard Deviation (GSD) of about 1.29. The particles were washed 6 times, where the 1st wash was conducted at pH of 10 at 63° C., followed by 3 washes with deionized water at room temperature, one wash carried out at a pH of 4.0 at 40° C., and finally the last wash with deionized water at room temperature.

The DSC scan of this toner indicated the melting point of the waxy component of the latex around 34.2° C. and a Tg onset around 48.6° C.

Fusing

The initial fusing performance of the waxless emulsion aggregation toner produced above was tested using an oil-less color fusing fixture having no cleaning web. The lack of cleaning web made it easier to observe any hot offset.

The sample was matte, peak gloss of 11. Its crease fix MFT was 159° C. and there were no signs of toner hot offsetting up to 210° C. The present waxless emulsion aggregation toner which used covalently bounded octadecylacrylate as the release material did not hot offset to fuser.

It will be appreciated that variations of the above-disclosed and other features and functions, or alternatives thereof, may be desirably combined into many other different systems or applications. Various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

The invention claimed is:

1. A chemical toner composition comprising a polymer polymerized from starting ingredients comprising a resin monomer and a release agent monomer, wherein the chemical toner composition comprises particles having a volume average particle size distribution index of about 1.30 or less.

2. The chemical toner composition of claim 1, wherein the release agent monomer is selected from at least one of the following:

(a) an acrylic monomer having the formula:

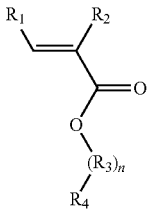

wherein $R_1$ is hydrogen or carboxylic acid or a salt thereof, $R_2$ is hydrogen, or methyl, or ethyl, $R_3$ is a methylene group wherein n is from about 15 to about 200, or $R_3$ is an ethoxy, propoxy or butoxy group, or a propylene group, wherein n is from about 10 to about 100, $R_4$ is a methyl group, a hydroxyl group, or a carboxylic acid group or a salt thereof, and (b) a styrenic monomer having the following formula:

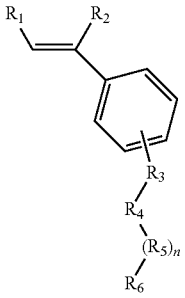

wherein $R_1$ is a hydrogen or a methyl group, $R_2$ is a hydrogen or a methyl group, $R_3$ is a methylene group, an oxygen, or a carbonyl group, $R_4$ is a methylene group or an oxygen, $R_5$ is a methylene group, n is from about 15 to about 200, or $R_5$ is an ethoxy, propoxy or butoxy group or a propylene group wherein n is from about 10 to about 100, $R_6$ is a hydrogen, a methyl group, a hydroxyl group, or a carboxylic acid group or a salt thereof.

3. The chemical toner composition of claim 1, wherein the chemical toner composition is substantially free of a non-covalently bonded release agent.

4. The chemical toner composition of claim 1, wherein the chemical toner composition comprises particles have a circularity ranging from about 0.930 to 1.000.

5. The chemical toner composition of claim 1, wherein the resin monomer comprises a styrene and an acrylate.

6. The chemical toner composition of claim 1, wherein the release agent monomer comprises an octadecylacrylate.

7. An emulsion aggregation toner composition comprising a polymer polymerized from starting ingredients comprising a resin monomer and a release agent monomer, wherein the emulsion aggregation toner composition comprises particles having a volume average particle size distribution index of about 1.30 or less.

8. The emulsion aggregation toner composition of claim 7, wherein the release agent monomer is selected from at least one of the following:

(a) an acrylic monomer having the formula:

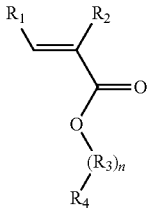

wherein $R_1$ is hydrogen or carboxylic acid or a salt thereof, $R_2$ is hydrogen, or methyl, or ethyl, $R_3$ is a methylene group wherein n is from about 15 to about 200, or $R_3$ is an ethoxy, propoxy or butoxy group, or a propylene group, wherein n is from about 10 to about 100, $R_4$ is a methyl group, a hydroxyl group, or a carboxylic acid group or a salt thereof, and (b) a styrenic monomer having the following formula:

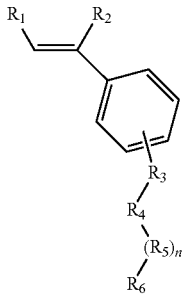

wherein $R_1$ is a hydrogen or a methyl group, $R_2$ is a hydrogen or a methyl group, $R_3$ is a methylene group, an oxygen, or a carbonyl group, $R_4$ is a methylene group or an oxygen, $R_5$ is a methylene group, n is from about 15 to about 200, or $R_5$ is an ethoxy, propoxy or butoxy group or a propylene group wherein n is from about 10 to about 100, $R_6$ is a hydrogen, a methyl group, a hydroxyl group, or a carboxylic acid group or a salt thereof.

9. The emulsion aggregation toner composition of claim 7, wherein the emulsion aggregation toner composition is substantially free of a non-covalently bonded release agent.

10. The emulsion aggregation toner composition of claim 7, wherein the emulsion aggregation toner composition comprises particles have a circularity ranging from about 0.930 to 1.000.

11. The emulsion aggregation toner composition of claim 7, wherein the resin monomer comprises a styrene and an acrylate.

12. The emulsion aggregation toner composition of claim 7, wherein the release agent monomer comprises an octadecylacrylate.

13. A process comprising:

(a) forming a dispersion comprising (i) a disperse phase including starting ingredients comprising a resin monomer and a release agent monomer; and (ii) a continuous phase including starting ingredients comprising water and a phase transport catalyst;

(b) polymerizing the resin monomer and the release agent monomer to result in a polymer;

(c) aggregating toner precursor materials comprising the polymer and a colorant to result in aggregated toner precursor materials; and (d) coalescing the aggregated toner precursor materials to result in an emulsion aggregation toner composition comprising the colorant and the polymer.

14. The process of claim 13, wherein the phase transport catalyst is a cyclodextrin, a cyclodextrin derivative, or a mixture thereof.

15. The process of claim 13, wherein the release agent monomer is selected from at least one of the following:

(a) an acrylic monomer having the formula:

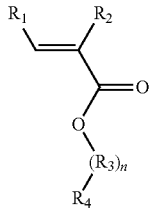

wherein $R_1$ is hydrogen or carboxylic acid or a salt thereof, $R_2$ is hydrogen, or methyl, or ethyl, $R_3$ is a methylene group wherein n is from about 15 to about 200, or $R_3$ is an ethoxy, propoxy or butoxy group, or a propylene group, wherein n is from about 10 to about 100, $R_4$ is a methyl group, a hydroxyl group, or a carboxylic acid group or a salt thereof, and (b) a styrenic monomer having the following formula:

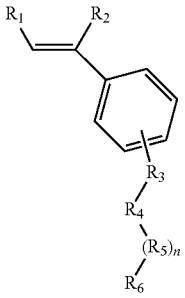

wherein $R_1$ is a hydrogen or a methyl group, $R_2$ is a hydrogen or a methyl group, $R_3$ is a methylene group, an oxygen, or a carbonyl group, $R_4$ is a methylene group or an oxygen;

$R_5$ is a methylene group, n is from about 15 to about 200, or $R_5$ is an ethoxy, propoxy or butoxy group or a propylene group wherein n is from about 10 to about 100, $R_6$ is a hydrogen, a methyl group, a hydroxyl group, or a carboxylic acid group or a salt thereof.

16. The process of claim 13, wherein the emulsion aggregation toner composition comprises particles having a volume average particle size distribution index of about 1.30 or less.

17. The process of claim 13, wherein the resin monomer comprises a styrene and an acrylate.

18. The process of claim 13, wherein the release agent monomer comprises an octadecylacrylate.

* * * * *